United States Patent [19]

Vivares

[11] Patent Number: 4,485,566

[45] Date of Patent: Dec. 4, 1984

[54] TUMBLER DRYER FOR THE DRYING OF LAUNDRY

[75] Inventor: Alain Vivares, Landau, Fed. Rep. of Germany

[73] Assignee: Ranco Incorporated, Dublin, Ohio

[21] Appl. No.: 325,421

[22] PCT Filed: Apr. 24, 1981

[86] PCT No.: PCT/EP81/00033

§ 371 Date: Nov. 23, 1981

§ 102(e) Date: Nov. 23, 1981

[30] Foreign Application Priority Data

Apr. 22, 1980 [DE] Fed. Rep. of Germany ..... 3015428

[51] Int. Cl.[3] ..... F26B 21/10

[52] U.S. Cl. ..... 34/44; 34/48; 34/55

[58] Field of Search ..... 34/48, 133, 46, 53, 34/55, 45, 44

[56] References Cited

U.S. PATENT DOCUMENTS 2,933,823 4/1960 Cramer et al. ..... 34/48

3,513,566 5/1970 Shacklock et al. ..... 34/133

FOREIGN PATENT DOCUMENTS 1470163 4/1977 United Kingdom .

*Primary Examiner*—Larry I. Schwartz

*Attorney, Agent, or Firm*—Watts, Hoffmann, Fisher & Heinke

[57] ABSTRACT

A tumble dryer for the drying of laundry comprises a drum (2) arranged in a housing (1) and driven by a motor (3), heating means (7) for heating the air entering the dryer and being guided through the drum (2), first and second temperature sensing means (12, 13) for sensing the temperatures of the air led into the drum (2) and being discharged from the drum (2), and control means connected to the temperature sensing means (12, 13) for energizing and de-energizing the heating means (7) and the drum motor (3). In order to ensure a cooling down period dependent on the drum content and humidity to achieve a desired remaining humidity of the drum content the air led to the drum is guided for preheating before passing the heating means over and around the drum (2), the first temperature sensing means (12) is arranged for sensing the temperature of the preheated air (10) upstream of the heating means (7) and the control means de-energizes the heating means (7) upon reaching a first presettable temperature difference of the preheated and the discharged air (10, 8) and de-energizes the drum motor (3) upon reaching a second temperature difference of the preheated and the discharged air (10, 8).

7 Claims, 2 Drawing Figures

TUMBLER DRYER FOR THE DRYING OF LAUNDRY

Figure 1:
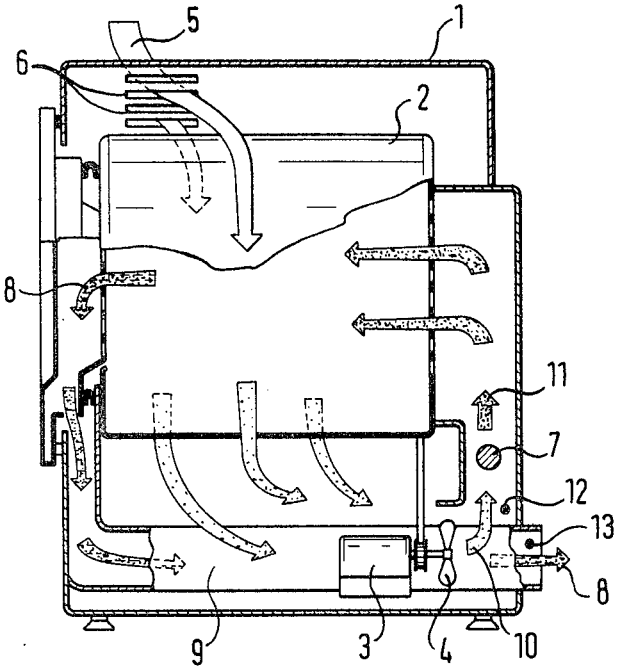

The invention relates to a tumble dryer for the drying of laundry, comprising a drum arranged in a housing and driven by a motor, heating means for heating the air entering the dryer and being guided through the drum, first and second temperature sensing means for sensing the temperatures of the air led into the drum and being discharged from the drum, and control means connected to the temperature sensing means for energizing and de-energizing the heating means and the drum motor.

Such a tumble dryer is known for example from the British Pat. No. 1,470,163. The temperature sensing means of this tumble dryer sense the temperatures of the air supplied to the drum and the air discharged from the drum and de-energize the heating means when a predeterminated temperature difference has been reached. The temperature of the air supplied to the drum is sensed after passing the heating means. This temperature neither varies with room temperature nor with room humidity. After de-energizing the heating means the drum motor remains energized for a pre-determinated period of time or is de-energized when a certain temperature of the discharged air is reached. A dependence of the further running period on the contents of the drum or the remaining humidity of the drum contents is not provided.

From the Austrian Pat. No. 190 024 there is further known a tumble dryer with heating means being provided above the drum and the air entering the dryer being guided twice along these heating means and entering the drum from above after having been heated solely by the heating means. No temperature difference control means are provided.

The object of the invention is to provide a tumble dryer of the type described at the beginning, which on the one hand permits a precise de-energizing of the heating means with the lowest possible circuit complexity, and on the other hand ensures a cooling down period dependent on the drum content and humidity with further energizing drum motor after the de-energizing of the heating means until the desired remaining humidity of the drum content is achieved.

According to the invention, this object is solved in that the air led to the drum is guided for preheating before passing the heating means over and around the drum, that the first temperature sensing means is arranged for sensing the temperature of the preheated air upstream of the heating means and that the control means de-energizes the heating means upon reaching a first presettable temperature difference of the preheated and the discharged air and de-energizes the drum motor upon reaching a second temperature difference of the preheated and the discharged air.

With this arrangement, it is achieved that on the one hand the temperature difference between the preheated and discharged air is kept relatively low during the entire drying cycle and the de-energizing of the heating means can take place with a relatively small temperature difference. On the other hand, the cooling period after de-energizing the heating means and with still energizing drum motor is not restricted to a pre-determined period of time or determinated merely dependent on the temperature of the discharged air, but is automatically adapted to the drum filling and also to its humidity. After termination of the drying cycle, the humidity of the dried laundry lies within the range desired for the further handling, namely independent of the filling degree of the drum.

The first temperature sensing means is expediently disposed directly in front of the heating means and protected against heat radiation therefrom.

The second temperature sensing means is advantageously disposed at the end of an outlet duct for air discharged from the dryer.

The temperature sensing means are expediently thermistors and the control means is an electronic control means.

Alternatively the temperature sensing means may be vapor or liquid filled sensors and the control means mechanical control means.

In accordance with the desired remaining humidity of the laundry upon termination of the drying cycle of the control means can be designed or adjusted, respectively, in such a manner that it de-energizes the drum motor upon reaching the second temperature difference equal zero, a low positive or a low negative value. In this respect, it is important that the temperature difference for de-energizing the drum motor is only effective after the heating means has been de-energized, as the temperature-time curves of the preheated and also of the discharged air proceed from a common point and the temperature-time curve of the discharged air can lie according to the design of the tumble dryer during the heating period for a longer time period below the temperature-time curve for the preheated air or always above same.

An embodiment of the invention is shown in the drawing and is described in more detail in the following. In the drawing FIG. 1 shows a schematic representation of a tumble dryer according to the invention with housing in section and drum partly in section and also outlet duct for the discharged air partly in section, and FIG. 2 shows a schematic representation of the temperature-time curves for the preheated and the discharged air.

Figure 2:
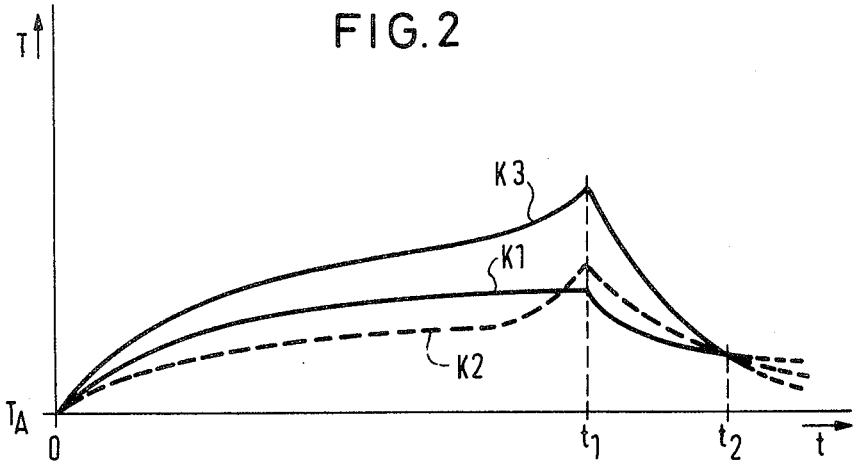

The tumble dryer schematically represented in FIG. 1 includes a housing 1 and a drum 2 rotatably positioned in the housing 1. The drum 2 is driven by a motor 3 in the lower portion of the housing 1. The motor 3 further drives a ventilator 4 which draws in ambient air 5 through slots 6 in the upper region of the housing 1 and presses same past a heating means 7 axially through the drum 2. The wet air 8 discharged by the drum 2 is discharged from the dryer via an outlet duct 9.

The ambient air 5 drawn in by the ventilator is guided over and around the drum 2 and thus preheated. The heating means 7 is thus supplied with preheated air 10, which is heated into hot air 11 before entering the drum 2.

Directly in front of the heating means 7 a first temperature sensing means 12, preferably in the form of a thermistor, is disposed, which is protected against heat radiation from the heating means 7. The temperature sensing means 12 senses the temperature of the preheated air 10. At the end of the outlet duct 9 for the wet air 8 discharged from the dryer, a second temperature sensing means 13, also preferably in the form of a thermistor, is disposed. This second temperature sensing means 13 senses the temperature of the air 8 discharged from the dryer. The sensing means 12 and 13 are connected to an electronic control means, not shown, by means of which the heating means 7 and the motor 3 are energized at the beginning of a drying cycle, the heating means 7 is de-energized to terminate the heating period and finally the motor 3 is also de-energized after a cooling down period and thus a drying cycle is terminated.

Alternatively the temperature sensing means 12 and 13 may be vapor or liquid filled sensors and the control means mechanical control means.

In FIG. 2 termperature-time curves $T=f(t)$ for the preheated air 10 and the air 8 discharged from the dryer are schematically represented.

The curve K1 shows the temperature course of the preheated air 10 during a drying cycle. When energizing the dryer at the point of time $t=0$, the temperature of the preheated air 10 increases constantly proceeding from the temperature $T_A$, the curve K1 showing a constantly decreasing gradient. When de-energizing the heating means 7 at the point of time $t=t_1$ (end of the heating period), the temperature of the preheated air 10 decreases constantly at first more steeply and then with increasing flatness until the point of time $t=t_2$, in which the motor 3 is de-energized (end of the drying cycle).

The temperature course of the air 8 discharged from the dryer is represented in the curves K2 and K3 in FIG. 2. In the first part of the heating period, the temperature of the discharged air 8 can lie above or below the temperature of the preheated air 10, according to the design of the dryer, as shown by the curves K2 or K3, respectively. At the point of time $t=0$, the temperature in both cases equals the temperature $T_A$ of the ambient air 5 and then increases with constantly decreasing pitch. Shortly before the end of the heating period, a steeper temperature increase takes place. With a pre-determined or adjustible positive temperature difference, respectively, between the temperature of the discharged air 8 and the temperature of the preheated air 10, which are sensed by the temperature sensing means 12 and 13, the control means de-energizes the heating means 7 in the point of time $t=t_1$. The temperature of the discharged air 8 now decreases at first steeply and then with constantly increasing flatness until the point of time $t=t_2$, at which time the motor 3 is de-energized and the drying cycle is terminated.

The point of time $t=t_2$ is reached in the curves represented in FIG. 2 when the temperature of the discharged air 8 is equal to the temperature of the preheated air 10. According to the desired remaining humidity of the dried laundry, however, the motor 3 can also be de-energized at the point of time $t=t_2$ upon reaching a small positive or negative difference between the temperatures of the preheated air 10 and the discharged air 8.

The cooling down period $t_2-t_1$ does not have a fixed, pre-determined time duration and is not dependent only on the temperature of the discharged air 8, but is namely dependent on the second temperature difference between the temperatures of the preheated air 10 and the discharged air 8. The time duration of the cooling down period is therefore a function of the filling degree of the drum 2 and the water absorbing capacity of the dried laundry. Thus, upon termination of the drying cycle, laundry having a humidity within a desired range is always obtained.

By sensing the temperature of the preheated air 10 instead of the temperature of the ambient air 5, it is further guaranteed that the temperature differences between the temperatures sensed by the temperature sensing means 12 and 13 are kept relatively low throughout the entire drying cycle, whereby a simple construction of the control means and precise switching possibilities for de-energizing the heating means 7 at the point of time $t=t_1$ and the motor 3 at the point of time $t=t_2$ result.

The de-energizing of the motor 3 upon termination of the drying cycle can take place for example after a crease-protective period of half-an-hour, during which time the motor 3 remains de-energized by means of a timer for 30 seconds, respectively, and then is energized for 4 seconds, respectively. Such a timer is expediently included in the control means. Furthermore, a time safe circuit can be provided in the control means, which automatically switches off the dryer for example two hours after commencement of the drying cycle.

Instead of the drum 2 another kind of drying chamber and instead of the motor 3 another means for moving the laundry during the drying cycle can be used.

I claim:

1. A tumble dryer for drying laundry or the like, comprising a drum supported in a housing and driven by a motor, heating means for heating air entering the drum, first and second temperature sensing means for sensing the temperatures of the air led into the drum and being discharged from the drum, and control means connected to the temperature sensing means for energizing and de-energizing the heating means and the drum motor, characterized in that the air is guided over and around the drum for preheating before passing the heating means, that the first temperature sensing means is arranged for sensing the temperature of the preheated air upstream of the heating means and that the control means de-energizes the heating means upon reaching a first presettable temperature difference of the preheated and the discharged air and de-energizes the motor upon reaching a second temperature difference of the preheated and the discharged air.

2. A tumble dryer according to claim 1, characterized in that the first temperature sensing means is arranged directly upstream of the heating means and protected against heat radiation from the heating means.

3. A tumble dryer according to claim 1 or 2, characterized in that the second temperature sensing means is arranged at the end of an outlet duct for air discharged from the dryer.

4. A tumble dryer according to claims 1, 2 or 3, characterized in that the temperature sensing means are thermistors and the control means is an electronic control means.

5. A tumble dryer according to claims 1, 2 or 3, characterized in that the temperature sensing means are vapor or liquid filled sensors and the control means are mechanical control means.

6. A tumble dryer according to claim 1 wherein said control means is constructed and arranged to de-energize said drum motor in response to a second temperature difference ranging between zero and a predetermined relatively low absolute temperature differential.

7. A tumble dryer for drying laundry or the like, including a drum supported in a housing and driven by a motor, heating means for heating air entering the drum, the heated air being led through the drum, and being discharged through an outlet duct, first and second temperature sensing means for respectively sensing the temperature of the air led to said heating means and the air being discharged from the drum, and control means connected to the temperature sensing means for energizing and de-energizing the heating means and the drum motor, characterized in that at least a portion of the air entering the drum is guided into heat transfer relationship with the drum for preheating by the drum before passing the heating means, that the first temperature sensing means is arranged for sensing the temperature of the preheated air upstream of the heating means and that the control means de-energizes the heating means upon reaching a first presettable temperature difference of the preheated and the discharged air and de-energizes the drum motor upon reaching a second temperature difference of the preheated and the discharged air.

* * * * *